US005259541A

United States Patent [19]

Reese

[11] Patent Number: 5,259,541

[45] Date of Patent: Nov. 9, 1993

[54] BELT WITH ATTACHED BAG

[76] Inventor: Bonnie Reese, P.O. Box 757, Orland, Calif. 95963

[21] Appl. No.: 955,409

[22] Filed: Oct. 2, 1992

[51] Int. Cl.[5] ..... A45F 3/00

[52] U.S. Cl. ..... 224/226; 224/224; 383/120

[58] Field of Search ..... 224/194, 223, 224, 226, 224/227, 228, 240, 253, 254; 383/117, 120, 105, 109, 119; 206/260, 273, 315.9; 150/112, 128

[56] References Cited

U.S. PATENT DOCUMENTS

| | | | |
|---|---|---|---|
| 367,996 | 8/1887 | Nathan | 224/226 |
| 1,693,266 | 11/1928 | Baldwin | 383/117 |
| 2,558,382 | 6/1951 | Previdi | 224/253 |
| 2,710,639 | 6/1955 | Farls | 224/253 |
| 2,712,843 | 7/1955 | Ottinger et al. | 383/117 |
| 3,158,300 | 11/1964 | Withee | 224/6 |
| 3,405,863 | 10/1968 | Kugler | 383/907 |
| 4,079,871 | 3/1978 | Sica | 224/226 |
| 4,416,404 | 11/1983 | Daniels | 224/224 |
| 4,440,525 | 4/1984 | Perla | 224/224 |

*Primary Examiner*—Henry J. Recla
*Assistant Examiner*—David J. Walczak
*Attorney, Agent, or Firm*—Beech & Collins

[57] ABSTRACT

An improved belt and attached bag specifically adapted for use in holding tennis balls while playing tennis that has a specifically adapted draw bag mechanism, belt mechanism and bag that is formed from a single piece of material that is easily washable.

4 Claims, 2 Drawing Sheets

BELT WITH ATTACHED BAG

FIELD OF THE INVENTION

The instant invention relates to an improved belt with attached bag for storing tennis balls while the wearer is playing tennis.

DESCRIPTION OF RELATED ART

There are existing belts but none have bags or pockets that hold tennis balls while the wearer is playing the game. Existing bags are not suitable as they would allow the balls to escape, are too bulky or do not give the required flexibility. Other devices for carrying the balls include pockets placed in shorts or pants. The pockets do not allow storage of a sufficient number of balls to be convenient and the balls stretch and distort the shorts and pants.

SUMMARY OF THE INVENTION

The primary objective of the present instant invention is to provide a convenient means of carrying tennis balls while playing tennis. The device is strapped around the waist and the tennis balls are placed inside the device. A convenient storage of tennis balls is provided while the wearer is free to move about without fear of losing the balls.

In accordance with the description presented herein, other objectives of this invention will become apparent when the description and drawings are reviewed.

DESCRIPTION OF THE PREFERRED EMBODIMENT

Figure 1:
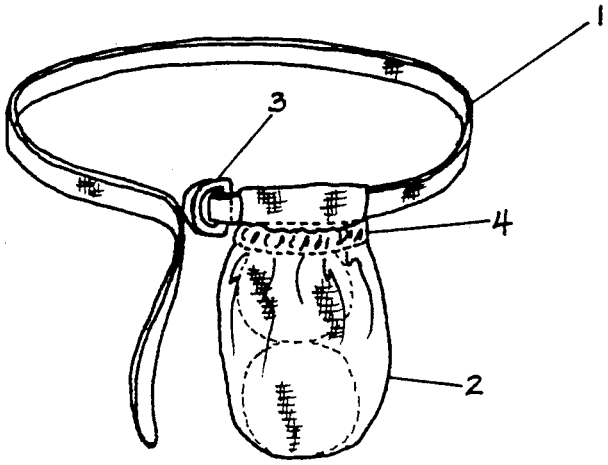
FIG. 1 is an isometric view of the improved tennis ball carrier with two tennis balls.
Figure 2:
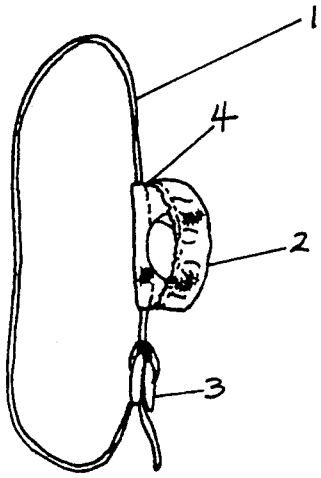
FIG. 2 is a top view of the improved tennis ball carrier.
Figure 3:
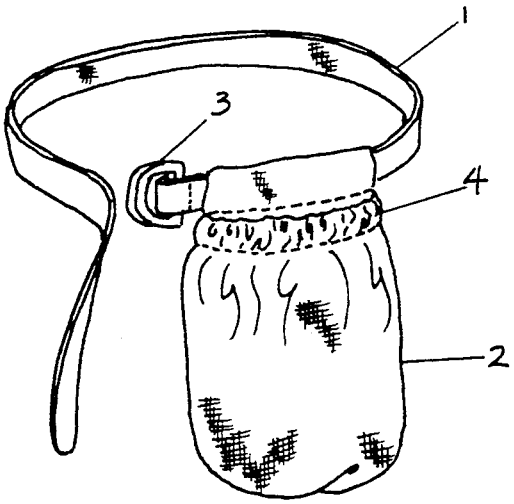
FIG. 3 is an isometric view of the improved tennis ball carrier with eight balls.

Referring to FIGS. 1 through 3, the belt with attached bag is illustrated. The belt (1) may be made in any manner. The belt (1) is of a size to fit around the waist of the user. The width of the belt (1) may be adjusted to any size to prevent discomfort of the wearer. Although other materials may be used, the preferred embodiment is a durable soft blend of cotton fabric that is easily washable. Attached to the belt is a bag (2) that is of sufficient size to hold several tennis balls. A bag (2) of sufficient size to hold eight balls is acceptable but also sizes that hold only two or three balls are desirable. The opening of the bag (2) and the bag (2) itself should fit loosely in order to capture the ball or an elastic band (4) that gathers at the opening of the bag (2) may be used. The belt (1) is fastened to the user by ordinary belt fastening means (3). The preferred embodiment uses two "D" rings to firmly fasten and hold the belt (1) length.

Figure 4:
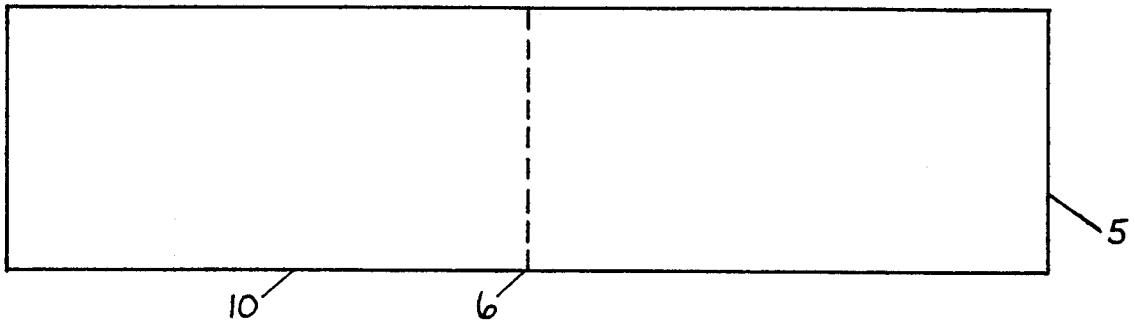
FIG. 4 is a side view of the tennis ball carrier before being assembled.
Figure 5:
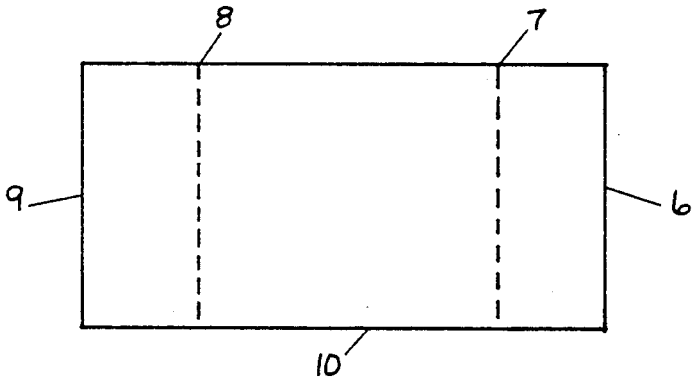
FIG. 5 is a side view of the tennis ball carrier partially assembled.
Figure 6:
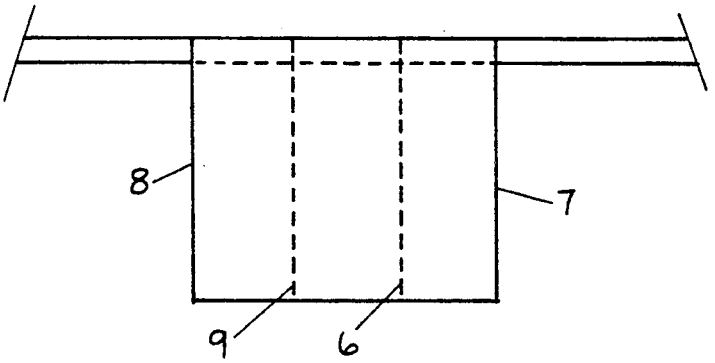
FIG. 6 is a side view of the tennis ball carrier before being fully assembled.

Referring to FIGS. 4 through 6 in the preferred embodiment, the bag is constructed from a single piece of cloth. A single piece of cloth is cut into the shape of a rectangle of sufficient size to hold the desired number of balls when the rectangular piece is folded in half. The rectangle is folded in half (6) and joined at the bottom (10) and side (5) to form a bag with only one side, the top, open. Each end of the joined bag is folded back along lines 8 and 7 a distance to assure to the desired thickness for the objects placed in the bag and the bottom (10) is resewn. When turned inside out, the desired bag is formed. One of the unjoined top portions of the bag is attached to the belt (1). A piece of elastic material is sewn inside the hem of the other side and the section gathered to form a partially closed bag opening.

I claim:

1. A belt with bag for storing tennis balls comprising:

a. a belt with two ends and attachment means to attach one end of the belt to the other end of the belt;

b. a bag of sufficient size to contain a tennis ball wherein the bag is formed from a single rectangular piece of material that is folded back along itself wherein the folded back portion is attached by an attachment means to the portion of material which has not been folded back at the side opposite the fold and at one of the sides not on the side opposite the fold thereby forming a bag mouth, and the side having the fold folded back toward an interior of the bag and the side that has been previously attached along the other side opposite the fold also folded back toward the interior and each side joined after the fold to the side that was not the side opposite the fold all such that when turned inside out the sides which were folded back towards the interior of the bag form the thickness of the interior of the bag; and c. an attachment means to attach the bag to the belt.

2. An improved belt with bag for tennis balls as in claim 1 wherein the bag is gathered at the mouth of the bag by an elastic means.

3. An improved belt with bag for tennis balls as in claim 1 wherein the bag is capable of containing a plurality of tennis balls.

4. An improved belt with bag for tennis balls as in claim 1 wherein the bag is made of loose flexible material that allows the bag to move flexibly when in use.

* * * * *